United States Patent [19]

Jarman

[11] 4,037,456

[45] July 26, 1977

[54] AUTO BODY CLAMP

[75] Inventor: Davis R. Jarman, Brunswick, Ga.

[73] Assignee: Virgil Hinson, Brunswick, Ga. ; a part interest

[21] Appl. No.: 705,564

[22] Filed: July 15, 1976

[51] Int. Cl.[2] ..... B21D 1/12

[52] U.S. Cl. ..... 72/325; 72/705; 294/116; 294/DIG. 1

[58] Field of Search ..... 72/705, 325; 294/116, 294/DIG. 1, DIG. 2; 26/96; 83/660, 700

[56] References Cited

U.S. PATENT DOCUMENTS

| | | | |
|---|---|---|---|
| 2,100,512 | 11/1937 | Kotowski | 294/116 |
| 2,213,014 | 8/1940 | Owen | 294/116 |
| 3,641,860 | 2/1972 | Whistler et al. | 83/700 |
| 3,827,279 | 8/1974 | Buske | 72/705 |
| 3,986,746 | 10/1976 | Chartier | 294/116 |

*Primary Examiner*—Lowell A. Larson

*Attorney, Agent, or Firm*—Clarence A. O'Brien; Harvey B. Jacobson

[57] ABSTRACT

An auto body clamp having first and second plates attachable to a pulling device and selectively drawn together at a metal-gripping jaw arrangement by a clamp which pivots the plates about a fulcrum formed by a ball disposed in recesses provided in the plates. The jaw arrangement includes teeth disposed in apertures provided in the plates, with the teeth of each plate being offset from the teeth of the other plate. Each of the teeth is arranged in a respective aperture for movement within the aperture relative to the respective plate. Setscrews are arranged in countersunk portions provided in the apertures for permitting variation in the amount a given tooth will extend beyond the respective plate when the tooth is applying pressure to a portion of an automobile body, and the like. A tongue connected to the ball disposed in the recesss of the plates advantageously forms the connection of the plates to a suitable pulling device.

3 Claims, 5 Drawing Figures

Fig. 1
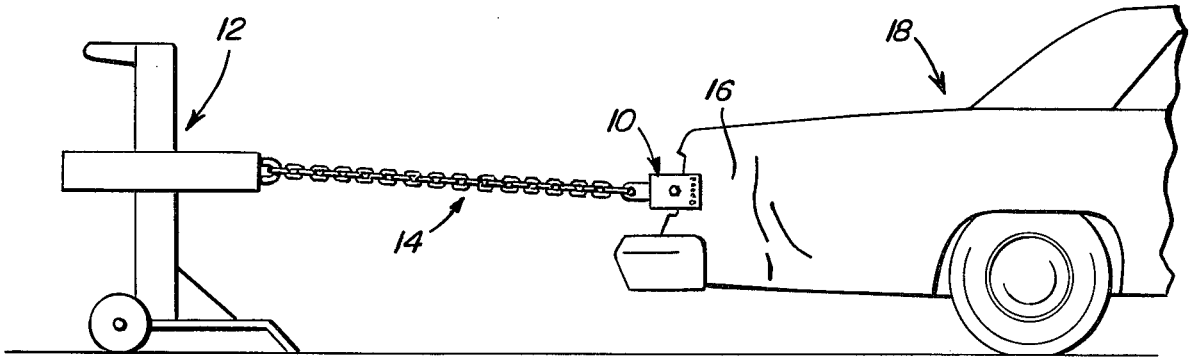
Fig. 2
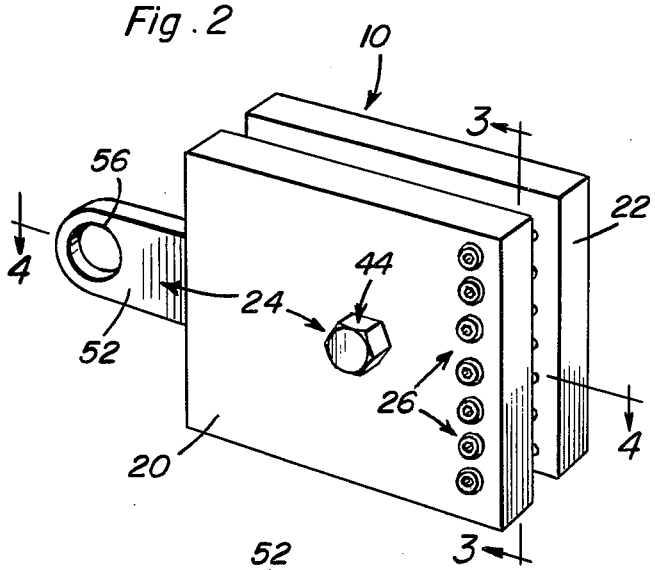
Fig. 3
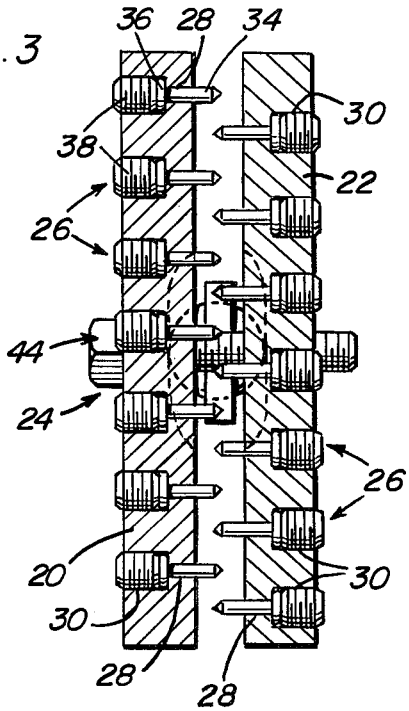
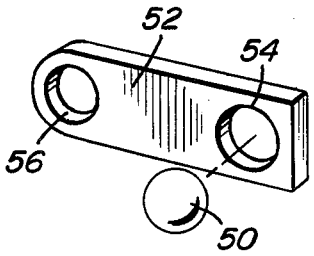
Fig. 5
Fig. 4
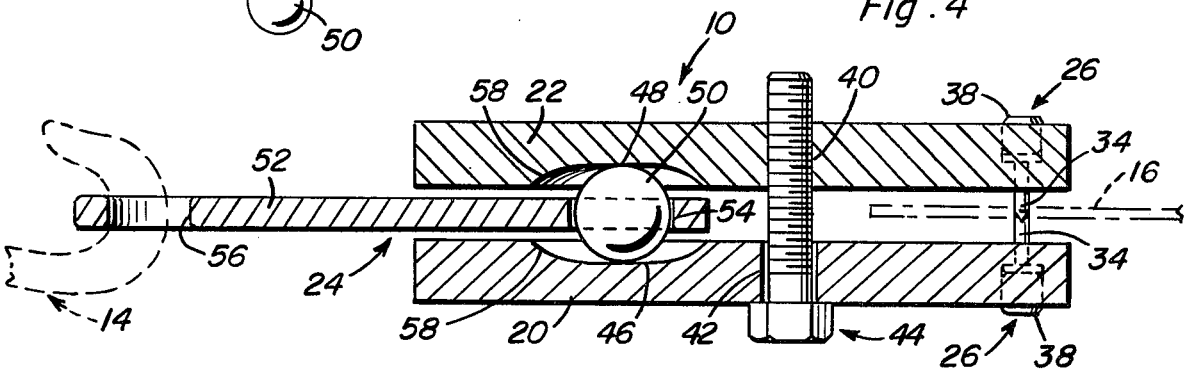

AUTO BODY CLAMP

CROSS REFERENCE TO A RELATED APPLICATION

The invention of this application is related to the invention of my copending application Ser. No. 596,369, filed July 16, 1975 and entitled "Body Sill Clamp" now Pat. No. 3,992,921.

BACKGROUND OF THE INVENTION

1. Field of the Invention

This invention relates generally to a sheet metal clamp, and particularly to an automobile body clamp for use in straightening the sheet metal of an automobile body.

2. Description of the Prior Art

The straightening of the sheet metal which forms the conventional automobile body, and the like, has practical limitations due to the difficulty in obtaining a firm grip on the sheet metal. This is particularly the case with unitized bodies, wherein a particularly firm grip must be obtained in order to exert sufficient force to straighten such bodies. Further, the metal of such unitized bodies, and the like, frequently varies in thickness, thus making the problem even more difficult.

Various clamps are known for gripping sheet metal, and the like, during the repair of automobile bodies. Quite commonly, these clamps involve the drawing together of jaw elements about a fulcrum by means of a conventional bolt and nut arrangement. Examples of such clamps can be found in U.S. Pat. Nos. 3,276,237, issued Oct. 4, 1966 to W. Transue; 3,744,837, issued July 10, 1973 to R. A. Jackson; 3,797,295, issued Mar. 19, 1974 to A. V. Sanchez; and 3,827,279, issued Aug. 6, 1974 to E. Buske.

It is also known in prior art clamps specifically intended for grasping the sheet metal of automobile bodies to use individually adjustable teeth, generally in the form of screws engaged with the threads of a threaded bore provided on the body of the clamp, for gripping a section of sheet metal of varying thickness. Examples of such clamps can be found in U.S. Pat. Nos. 2,855,972, issued Oct. 14, 1958 to R. I. Greider; and 3,111,159, issued Nov. 19, 1963 to V. J. Jenkins. These known adjustable teeth, however, must be individually adjusted by positively tightening each of the screws forming the teeth down against the metal being gripped.

SUMMARY OF THE INVENTION

It is an object of the present invention to provide an automobile body clamp which can firmly grip welded sections and connect it to conventional automobile body and frame repair pulling equipment in a simple yet reliable manner.

It is another object of the present invention to provide an automobile body clamp that is particularly suited for use with unitized automobile bodies.

It is yet another object of the present invention to provide a clamp provided with teeth that self-adjust to varying thicknesses of a piece of sheet material being gripped.

These and other objects are achieved according to the present invention by providing a clamp having: first and second plates attachable to a pulling device and disposed in adjacent relation; a jaw arrangement including at least one tooth, and preferably a plurality of teeth, adjustably mounted on a one of the plates for penetrating metal of varying thicknesses arranged between the plates adjacent the jaw arrangement; and a clamp arrangement engaging the first and second plates for selectively drawing the plates together at the jaw arrangement in order to bring the tooth or teeth into gripping relation with the sheet material disposed between the plates.

The jaw arrangement preferably includes a plurality of apertures provided in the plates, and countersunk over a portion thereof. The teeth disposed in these countersunk apertures include a pointed shank disposed in the aperture and extending between the countersunk portion of the aperture and the outer surface of the respective plate. A head provided on the shank is disposed within the countersunk portion of an associated apeture, and is of a size larger than the aperture so as to form a shoulder which prevents the head from passing through the apeture and out of the plate. A restraining device preferably in the form of a setscrew, and the like, is adjustably disposed in a threaded portion of the countersunk aperture for varying travel of the head of the tooth within the countersunk portion and simultaneously varying the minimum extent of the shank beyond the respective plate. In other words, by varying the position of a setscrew within the countersunk portion of an associated aperture, the pressure on a piece of sheet material being gripped can be made uniform, while the arrangement eliminates the necessity of using shims, and the like, between the head of the tooth and the retaining member due to the independent adjustment feature.

Each of the plates is advantageously provided with a through hole mating with the corresponding hole in the other of the plates, and an adjustable fastener such as a bolt is arranged in the holes in order to draw the plates toward one another. Although a nut can be employed in conjunction with the bolt, it is contemplated that the hole provided in one of the plates will be furnished with screw threads with which the threads of the bolt engage. A fulcrum is preferably formed at a point spaced from the through holes in the plates in the direction away from the jaw arrangement for permitting the plates to swing relative to one another and be drawn together at the teeth thereof by the aforementioned bolt. Specifically, each of the plates is provided with a recess disposed opposite the recess provided in the other of the plates, with a ball being movably disposed in the recesses so as to provide the fulcrum. A tongue which is connectible to a conventional pulling device is provided with a through opening which receives the ball disposed in the aforementioned recesses. This arrangement has the added advantage of not only permitting connection of the plates to a pulling device, but of biasing the ball up against cam surfaces partially forming the recesses in the plates in order to cause the teeth disposed at the other end of the plates to tighten in a desired manner.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary, schematic view showing a clamp according to the present invention being employed in conjunction with a conventional pulling device to straighten a fender of an automobile body.

FIG. 2 is a perspective view showing a clamp according to the present invention.

FIG. 3 is an enlarged, sectional view taken generally along the line 3—3 of FIG. 2.

FIG. 4 is an enlarged, sectional view taken generally along the line 4—4 of FIG. 2.

FIG. 5 is an exploded, perspective view, showing the ball and tongue which form the fulcrum and attachment arrangement for a clamp according to the present invention.

DESCRIPTION OF THE PREFERRED EMBODIMENTS

Referring now more particularly to FIG. 1 of the drawing, an automobile body clamp 10 according to the present invention is shown connected to a conventional pulling device 12 as by a chain 14. Clamp 10 is itself gripping a right rear fender 16 of a conventional automobile 18 for the purpose of straightening fender 16 in cooperation with pulling device 12.

Referring now more particularly to FIGS. 2 through 5 of the drawings, clamp 10 includes first and second substantially planar plates 20 and 22 normally disposed in generally parallel adjacent relation and attachable to pulling device 12 by means of a clamp and attachment arrangement 24. The latter is arranged engaging the first and second plates for selectively drawing the plates together at jaws 26 in order to cause jaws 26 to penetrate the sheet metal forming fender 16.

Jaws 26 include a plurality of through apertures 28 provided in each of the plates 20 and 22 in such a manner that each of the plates 20 and 22 has at least one aperture 28. Each of the apertures 28 is provided with a countersunk portion 30 which receives a respective one of a plurality of teeth 32. As perhaps can best be seen from FIG. 3, the teeth 32 of each of the plates 20 and 22 are offset from the teeth 32 of the other of the plates 22, 20 in order to create an interdigitating gripping action. Each of the teeth 32 includes a shank 34 disposed in a respective one of the apertures 28 and provided with a head 36. As can also be seen from FIG. 3, the countersunk portion 30 associated with each aperture 28 forms a shoulder due to being a size larger than the aperture in order to create an abutment for head 36 and prevent the associated tooth 32 from passing completely through an associated aperture 28 in any direction except out through the countersunk portion 30. Restraining devices preferably in the form of the illustrated setscrews 38 are adjustably disposed, as by screw threads provided in the countersunk portions 30, for varying the amount of travel of head 36 within the countersunk portion 30 and simultaneously varying the minimal extent of an associated pointed shank 34 beyond an adjacent surface of the respective plate 20, 22.

By this arrangement, worn teeth 32 can be replaced quickly and inexpensively. Further, when the metal being gripped is not of uniform thickness, adjustment on the setscrews 38 is made as necessary to apply equal pressure on all of the teeth 32.

Each of the plates 20, 22 is provided with a through hole 40 and 42, respectively, mating with the hole 42, 40 provided in the other of the plates 22, 20. An adjustable fastener such as the illustrated bolt 44 is arranged in the holes 40, 42 and is either threadingly engaged with a nut (not shown) or, as illustrated, hole 40 is provided with internal screw threads which threadingly engage with the bolt 44 in order to cause plates 20 and 22 to be drawn toward one another in a known manner.

Preferably, the plates 20 and 22 are drawn toward one another about a fulcrum formed by an arrangement wherein each of the plates 20 and 22 is provided with a recess 46 and 48, respectively, which are arranged opposite one another and receive a ball 50. As will be explained more fully below, recesses 46 and 48 are so constructed as to permit ball 50 longitudinal movement with respect to the planes of plates 20 and 22. A tongue 52 is providedwith a through opening 54 which receives ball 50, and with an eye 56 which permits tongue 52, and thus plates 20 and 22, to be connected to a conventional pulling device 12 as by the conventional hook provided on a chain 14, and the like. Thus, not only does recesses 46, 48 and ball 50 form a fulcrum about which plates 20 and 22 may pivot, but simultaneously forms an arrangement for facilitating attachment of clamp 10 to a conventional pulling device.

Further, not only does tongue 52 permit attachment of clamp 10 to a pulling device 12, but as a pull is made on tongue 52 by the pulling device 12, ball 50 will be caused to roll up the inclines 58 provided at the ends of recesses 46 and 48 disposed closest to the point of attachment of chain 14 to tongue 52 so as to make plates 20 and 22 widen at that associated end and cause the teeth 32 on the bottom, or plate 20 as viewed in FIG. 4, to grip tighter as more pressure is applied to the clamp 10. Further, using the ball 50 allows tongue 52 to swivel, thus making pulls in all directions possible.

As will be understood from the above description and from the drawings, a clamp 10 according to the present invention provides for uniform adjustment of teeth 32 on sheet material of varying thickness in a simple yet reliable manner, and simultaneously permits great versatility in the kinds of pulls that can be accomplished.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An automobile body clamp, comprising, in combination:

a. first and second plates attachable to a pulling device, the plates being disposed in an adjacent relation;

b. jaw means mounted on at least one of the plates for gripping sheet material arranged between the plates; and c. clamp means arranged engaging the first and second plates for selectively drawing the plates together at the jaw means, the clamp means including each of the plates being provided with a through hole mating with the hole provided in the other of the plates, and an adjustable fastener arranged in the holes for selectively drawing the plates toward one another, and the clamp means further including fulcrum and attachment means for permitting attachment of the plates to a pulling device while simultaneously forming a fulcrum about which the plates pivot under the influence of the adjustable fastener, with the attachment means including each of the plates being provided with a recess disposed opposite the recess provided in the other of the plates, the holes provided in the plates being arranged between the teeth and the recesses, a ball movably arranged in the recesses, and a tongue connectible to a pulling device and provided with a through opening, the ball being disposed in the opening and mounting the tongue for swivel movement, the recesses being provided with opposed inclines which function as cam surfaces causing the plates to widen at the associated end thereof when a pull on the tongue causes the ball to roll up the inclines.

2. A structure as defined in claim 1, wherein the jaw means includes a plurality of teeth adjustably mounted on the plates for penetrating the sheet material being gripped by the jaw means, each of the plates having at least one of the teeth, with the teeth of each of the plates being offset from the teeth of the other of the plates.

3. A structure as defined in claim 2, wherein the jaw means further includes a plurality of through apertures provided in the plates and countersunk over a portion thereof, each of the teeth including a shank disposed in a respective one of the apertures and extending between the countersunk portion and the outside of the associated one of the plates, and a head provided on the shank and disposed in the countersunk portion, the head being of a size larger than the aperture, with restraining means being adjustably disposed in the countersunk portion for varying travel of the head of each of the teeth within the countersunk portion and for simultaneously varying the minimum extent of the shank beyond the plate so that a predetermined uniform pressure may be exerted on a piece of material being gripped between the plates.

* * * * *